US009643437B2

(12) United States Patent
Yanagisawa et al.

(10) Patent No.: US 9,643,437 B2
(45) Date of Patent: May 9, 2017

(54) PRINTER THAT AVOIDS EXPOSURE OF A STAR WHEEL

(71) Applicant: Seiko Epson Corporation, Tokyo (JP)

(72) Inventors: Fumihiko Yanagisawa, Matsumoto (JP); Taku Hirashima, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/078,770

(22) Filed: Mar. 23, 2016

(65) Prior Publication Data

US 2016/0288539 A1 Oct. 6, 2016

(30) Foreign Application Priority Data

Apr. 1, 2015 (JP) ..... 2015-074873

(51) Int. Cl.
*B41J 25/308* (2006.01)
*B41J 25/316* (2006.01)

(52) U.S. Cl.
CPC ..... *B41J 25/3084* (2013.01); *B41J 25/3086* (2013.01); *B41J 25/3088* (2013.01); *B41J 25/316* (2013.01); *B41J 25/308* (2013.01)

(58) Field of Classification Search
CPC B41J 25/3084; B41J 25/3086; B41J 25/3088; B41J 25/316; B41J 11/20; B41J 25/308
See application file for complete search history.

(56) References Cited

U.S. PATENT DOCUMENTS

| | | | | |
|---|---|---|---|---|
| 5,373,312 | A * | 12/1994 | Fujioka | B41J 11/002 101/424.1 |
| 7,316,477 | B2 | 1/2008 | Yoda | |
| 7,575,317 | B2 | 8/2009 | Yoda | |
| 7,661,811 | B2 | 2/2010 | Yoda | |
| 8,210,674 | B2 | 7/2012 | Sugahara | |
| 8,714,734 | B2 * | 5/2014 | Sugitani | B41J 11/005 347/101 |
| 2010/0128077 | A1 * | 5/2010 | Sugahara | B41J 29/38 347/14 |

FOREIGN PATENT DOCUMENTS

| | | | |
|---|---|---|---|
| JP | 04-164766 | A | 6/1992 |
| JP | 4274180 | B2 | 6/2009 |
| JP | 2009-262544 | A | 11/2009 |

* cited by examiner

*Primary Examiner* — Henok Legesse
(74) *Attorney, Agent, or Firm* — Nutter McClennen & Fish LLP; John J. Penny, Jr.

(57) ABSTRACT

A simple configuration avoids exposure of a star wheel that prevents the media from lifting up when the media conveyance path opens. A platen top unit 20 that supports first and second star wheels 25A, 25B is separated from an opening and closing platen unit 8, and is supported movably vertically. when the platen unit 8 is moved to the open position 8B to open the third conveyance path section 10*c* of the conveyance path 10 when a paper jam occurs, for example, the head elevator 17 is controlled to raise the platen top unit 20 and retract the first and second star wheels 25A, 25B supported by the platen top unit 20 to a position removed from easy contact with the user's hands.

14 Claims, 9 Drawing Sheets

PRINTER THAT AVOIDS EXPOSURE OF A STAR WHEEL

BACKGROUND

1. Technical Field

The present invention relates to a printer having a star wheel to prevent sheet media from lifting up.

2. Related Art

A star wheel having protrusions formed at a regular pitch around the outside is commonly used in printers to prevent sheet media from separating from the platen surface and other parts of the media conveyance path (such as the conveyor belt). JP-A-H04-164766 describes such a printer. The image forming device (printer) described in claim JP-A-H04-164766 has a star wheel rotatably attached to a movable shaft that spans the gap between lever-shaped support brackets. When the top of the device closes, the protrusions on the star wheel contact the paper (media) on the conveyance surface of the paper conveyor belt, and prevent the media from lifting away from the surface.

The conveyance path of the printer opens and closes to remove paper jams or for other maintenance. In a printer that holds media down with a star wheel, the star wheel may be exposed to the space that is opened when the conveyance path is opened. When the star wheel is exposed, the operator's hand or the jammed paper may contact the star wheel, the star wheel may be damaged, and ease of maintenance may drop.

The star wheel in the printer described in JP-A-H04-164766 is covered by the support brackets when the conveyance path is opened. More specifically, the movable shaft on which the star wheel is mounted can move inside a slot formed in the support brackets, and when the top unit is opened, the support brackets descend of their own weight and move to a position below the star wheel. As a result, the star wheel is covered by the support brackets so that it won't be touched by the operator's hand.

The construction described in JP-A-H04-164766, however, requires a member (the support brackets) to cover the star wheel to prevent exposing the star wheel, the parts count therefore increases, and construction is complicated.

The present invention provides a printer with a simple configuration that prevents a star wheel used to prevent media from lifting up from being exposed to the conveyance path when the conveyance path is opened.

SUMMARY

A printer according to the invention has: a printhead; a platen unit that has a platen surface that supports sheet media, and moves between a head-opposing position where the platen surface is opposite the printhead with a specific gap therebetween, and an open position separated from the printhead more than at the head-opposing position; and a star wheel support member that is located above the platen unit at the head-opposing position and supports a star wheel that suppresses the media. The star wheel support member is movable between a first position in contact with the platen unit, and a second position separated from the platen surface more than at the first position.

In this aspect of the invention, the star wheel support member can move in the direction away from the platen surface, and can retract the star wheel from the media conveyance path between the printhead and platen surface. Thus comprised, exposure of the star wheel to the media conveyance path can be prevented when the platen unit is moved to the open position and the media conveyance path is opened. Damage to the star wheel and a drop in ease of use can be avoided. The parts configuration can also be simplified because there is no need for a member to cover the star wheel or a mechanism to move such member.

Preferably, the printer has a support frame that supports the star wheel support member movably to the first position and the second position; and a spring disposed between the support frame and the star wheel support member, and urging the star wheel support member to the second position.

Thus comprised, the star wheel support member can be supported retractably from the media conveyance path by a simple configuration.

Further preferably, the support frame has a first frame disposed on one side of the platen unit, and the first frame has a first opening extending in the direction of movement of the star wheel support member; a first protrusion disposed in the first opening is formed in one end of the star wheel support member; and the spring includes a first spring that urges the first protrusion from the first position toward the second position.

Thus comprised, the star wheel support member can be supported movably to a first position and a second position by a simple configuration.

Further preferably, the support frame has a second frame disposed on the other side of the platen unit, and the second frame has a second opening extending in the direction of movement of the star wheel support member; a second protrusion disposed in the second opening is formed on the other end of the star wheel support member; and the spring includes a second spring that urges the second protrusion from the first position toward the second position.

Thus comprised, the star wheel support member can be moved to the first position and second position by moving the star wheel support member parallel.

Further alternatively, the support frame has a second frame disposed on the other side of the platen unit; and the second frame pivotably supports the other end of the star wheel support member.

Thus comprised, the star wheel support member can be moved to the first position and second position by a simple support configuration that causes the star wheel support member to pivot on one end.

Further preferably, the direction of movement of the star wheel support member is perpendicular to the platen surface.

Because it is sufficient with this configuration to provide a retraction space for the star wheel support member above the platen unit, the space emptied by retracting the printhead can be used as the retraction space of the star wheel support member. Space efficiency is therefore good, which is useful for making the printer smaller.

Further preferably, the printer has a head moving mechanism configured to move the printhead in the directions toward and away from the platen surface; and the star wheel support member is pressed against the platen unit and positioned to the first position by the printhead approaching the platen surface.

Thus comprised, operation of the printhead can be used to move the star wheel support member to the position (first position) pushing against the media with the star wheel. There is, therefore, no need for an independent drive source to move the star wheel support member. The parts configuration can therefore be simplified.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a printer according to the present invention is described below with reference to the accompanying figures.

General Configuration

Figure 1:
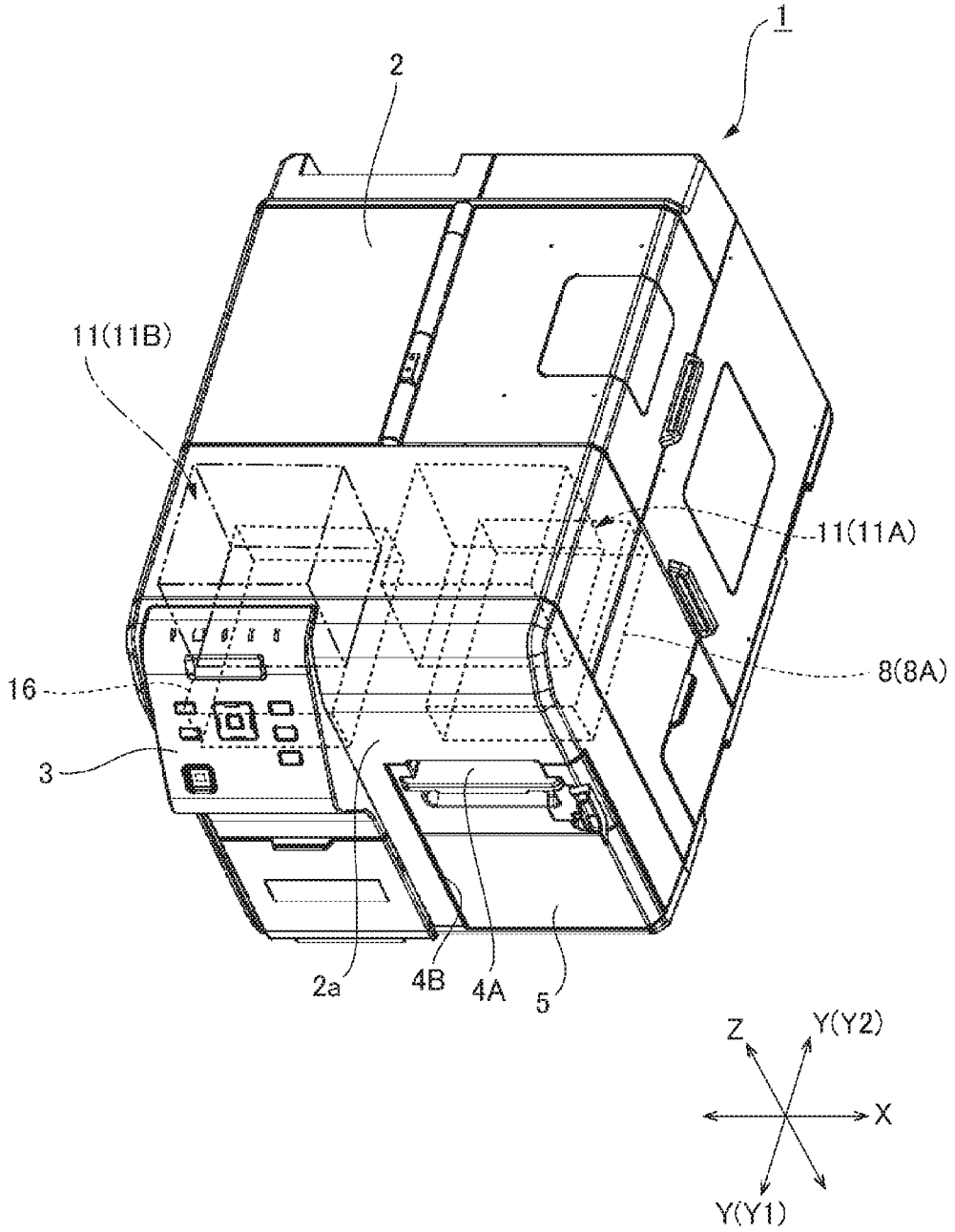
FIG. 1 is an external oblique view of a printer according to an embodiment of the invention.
Figure 2:
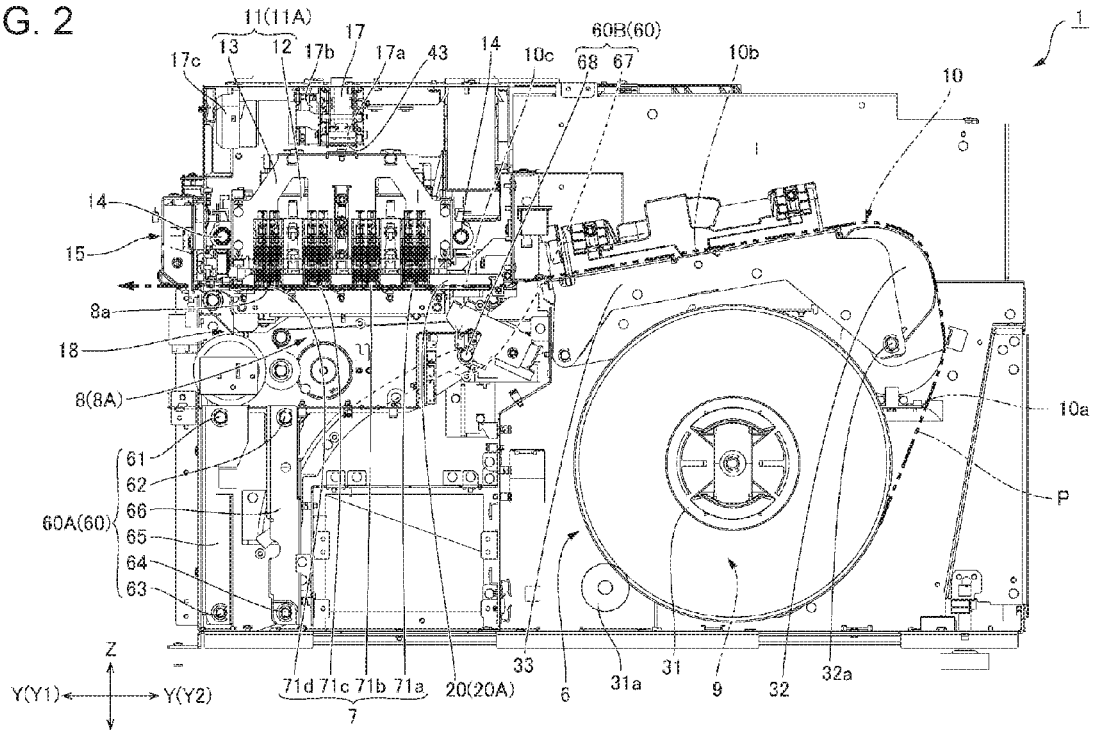
FIG. 2 is a vertical section view showing the internal configuration of the printer in FIG. 1.

FIG. 1 is an external oblique view of a printer according to the invention. FIG. 2 is a vertical section view showing the internal configuration of the printer. As shown in FIG. 1, the printer 1 has a printer cabinet 2 that is basically box-shaped and is long from front to back. An operating panel 3 is disposed at the top of the front 2*a* of the printer cabinet 2 on one side of the width, and a paper exit 4A is formed on the other side. An opening 4B that opens and closes during maintenance is disposed below the paper exit 4A, and an access cover 5 is disposed to this opening 4B.

The invention is described below with reference a transverse axis X across the device width, the longitudinal axis Y between the front and back of the device, and a vertical axis Z. The three directional axes X, Y, and Z are mutually perpendicular. Note also that Y1 denotes the front of the printer, and Y2 denotes the back of the printer.

As shown in FIG. 2, a roll paper compartment 6 is formed inside the printer cabinet 2 at the bottom at the printer back Y2. A printhead 7 is disposed at the top of the printer front Y1, and a platen unit 8 is disposed at the bottom at the printer front Y1. The printhead 7 is disposed with the nozzle face facing down. The platen unit 8 has a horizontal platen surface 8*a* opposite the nozzle face of the printhead 7 with a specific gap therebetween. The platen surface 8*a* includes the horizontal belt portion 81*a* of the conveyor belt 81 described below.

Inside the printer cabinet 2, the continuous paper P pulled from the paper roll 9 in the roll paper compartment 6 is conveyed through the conveyance path 10 indicated by the imaginary line. The recording paper P passes the printing position of the printhead 7, is conveyed toward the paper exit 4A opened in the front 2*a* of the printer cabinet 2, and is discharged from the paper exit 4A.

The conveyance path 10 includes a first conveyance path section 10*a*, second conveyance path section 10*b*, and a third conveyance path section 10*c*. The first conveyance path section 10*a* that extends diagonally upward toward the back Y2 from the roll paper compartment 6. The second conveyance path section 10*b* continues from the top end of the first conveyance path section 10*a* toward the front Y1 and descends gradually to the platen surface 8*a*. The third conveyance path section 10*c* extends horizontally from the front Y1 end of the second conveyance path section 10*b*, that is, from the back Y2 end of the platen surface 8*a*, to the front Y1 of the printer.

A roll spindle 31 on which the paper roll 9 is installed is disposed in the roll paper compartment 6. The roll spindle 31 extends on the transverse axis X, and is driven rotationally by drive power from a media supply motor 31*a* disposed near the bottom of the printer cabinet 2. When installed to the roll spindle 31, the paper roll 9 does not rotate relative to the roll spindle 31. When the roll spindle 31 turns, the recording paper P is delivered from the paper roll 9 to the first conveyance path section 10*a* of the conveyance path 10.

A tension lever 32 that applies tension to the recording paper P is disposed to the conveyance path 10 near the top end of the first conveyance path section 10*a* and the back Y2 end of the second conveyance path section 10*b* where the conveyance path curves. The distal end of the tension lever 32 has a curved outside surface where the tension lever 32 contacts the media, and the recording paper P travels along this curved surface. The tension lever 32 pivots on an axis of rotation 32*a* on the transverse axis X. The tension lever 32 is urged by a spring member (not shown in the figure) to the back Y2.

A paper guide 33 is disposed on the front Y1 side of the tension lever 32. The paper guide 33 is included in the second conveyance path section 10*b* of the conveyance path 10. The paper guide 33 is shaped to descend gently to the front Y1, and guides the recording paper P from the tension lever 32 toward the platen surface 8*a*.

Printhead Support Mechanism

The printhead 7 is an inkjet line head, and includes four heads, first head 71*a*, second head 71*b*, third head 71*c*, and fourth head 71*d*. These four heads are narrow and long on the transverse axis X, and are disposed at a regular interval on the longitudinal axis Y. Rows of ink nozzles that eject ink droplets are formed in the nozzle face of each head. The length of each ink nozzle row is greater than the maximum width of the recording paper P that can be used. The printhead 7 is mounted on a carriage 11. The carriage 11 includes a head frame 12 that holds the printhead 7, and a carriage frame 13 that supports the head frame 12. The head frame 12 moves on the vertical axis Z relative to the carriage frame 13.

Figure 3A:
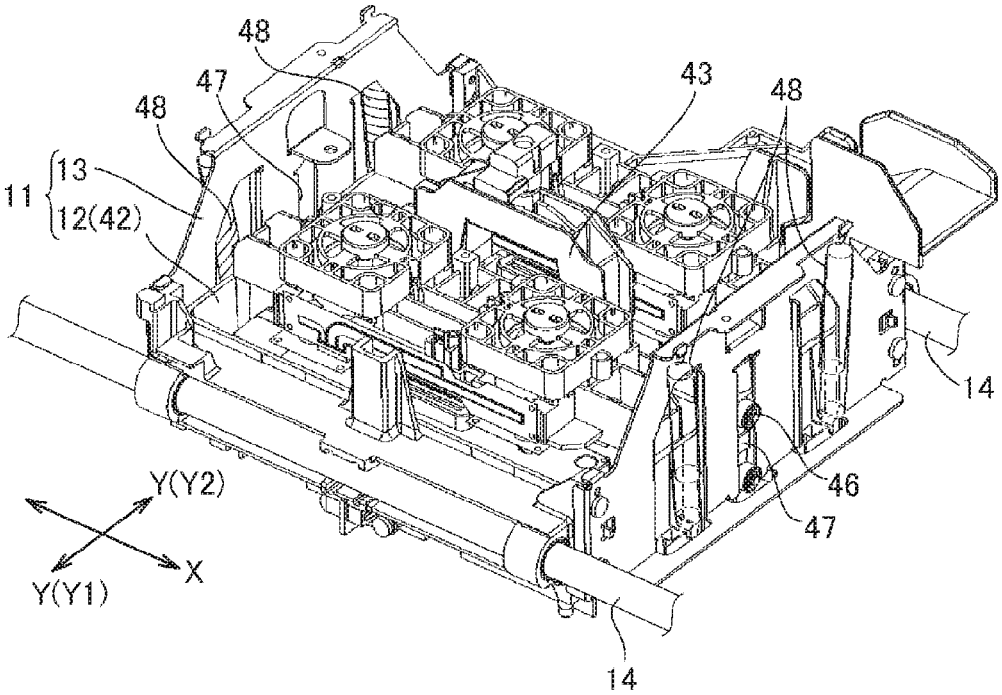
FIGS. 3A and 3B are an oblique view and a bottom view of the carriage that carries the printhead.
Figure 3B:
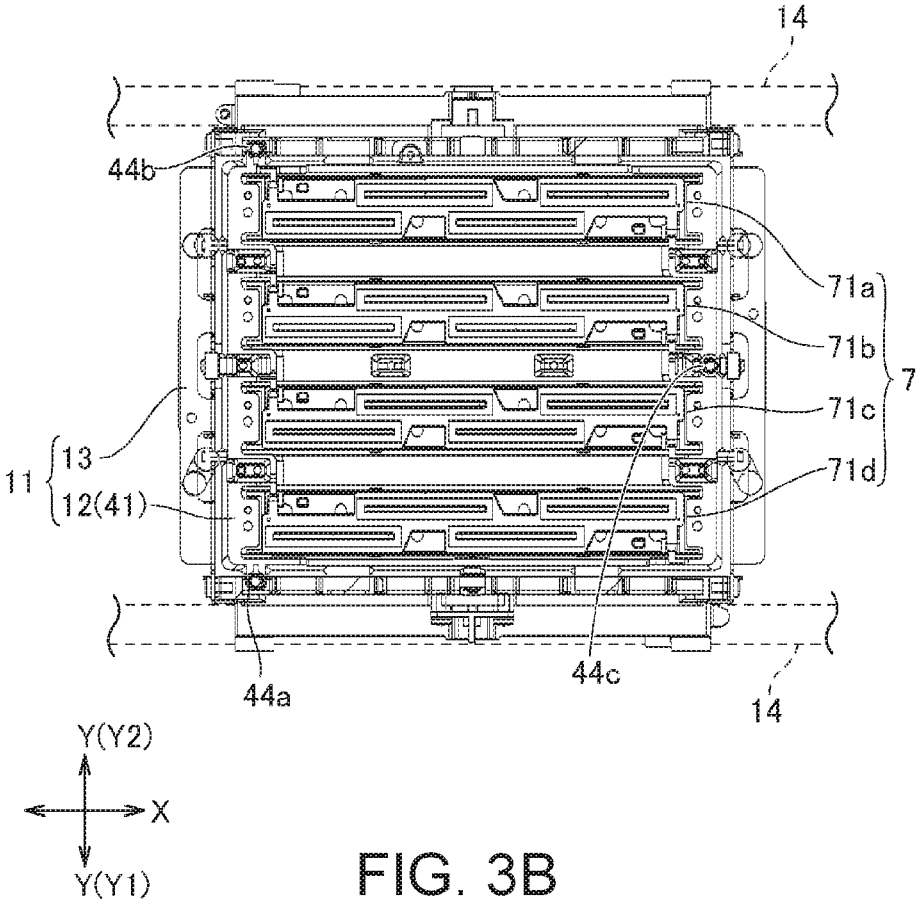

FIGS. 3A and 3B illustrate the carriage 11 that carries the printhead 7. FIG. 3A is an oblique view from diagonally above the top, and FIG. 3B is a bottom view from the platen unit 8 side. The head frame 12 includes a rectangular bottom 41, a rectangular cylinder 42 rising from the outside edges of the bottom 41, and a operator 43 rising from the middle of the bottom 41. The top end of the operator 43 is above the top of the printhead 7. The four line heads (first head 71*a* to fourth head 71*d*) of the printhead 7 are inserted from above to the rectangular cylinder 42, and are held by the head frame 12. The bottom ends of the line heads (first head 71*a* to fourth head 71*d*) held by the head frame 12 are below the bottom 41. Head-side stops 44*a*, 44*b*, 44*c* are formed on the bottom 41 at positions where they can contact three balls 24 held by the platen top unit 20 described below. The three balls 24 held by the platen top unit 20 described below contact the head-side stops 44*a*, 44*b*, 44*c*.

The carriage frame 13 is a frame-like member disposed on the inside circumference side of the head frame 12. A pair of guide channels 47 that extend on the vertical axis Z are formed on the side of the carriage frame 13 facing the transverse axis X. When the head frame 12 is inside the carriage frame 13, each of a pair of guide rollers 46 disposed on the side facing the head frame 12 are inserted to the guide channels 47. As a result, the head frame 12 is supported by the carriage frame 13 on the vertical axis Z. The head frame 12 is urged upward by the urging force of four coil springs 48 disposed between the head frame 12 and carriage frame 13.

A pair of parallel carriage guide rails 14 is disposed extending on the transverse axis X on the opposite sides of the carriage 11 on the longitudinal axis Y. The carriage 11 is supported movably on the transverse axis X by this pair of carriage guide rails 14. As shown in FIG. 2, a carriage moving mechanism 15 is disposed on the front Y1 side of the carriage 11. The carriage moving mechanism 15 moves the carriage 11 along the pair of carriage guide rails 14 bidirectionally on the transverse axis X.

The carriage 11 moves between the opposing position 11A indicated by the dotted line in FIG. 1, and the standby position 11B indicated by the double-dotted line in FIG. 1.

When the carriage 11 is at the opposing position 11A, the printhead 7 mounted on the carriage 11 is opposite the platen unit 8. When the carriage 11 is at the standby position 11B, the printhead 7 mounted on the carriage 11 is not opposite the platen unit 8. A head maintenance unit 16 is disposed below the standby position 11B, and when the carriage 11 moves to the standby position 11B, the printhead 7 is opposite the head maintenance unit 16. A head elevator 17 (see FIG. 2) that lowers the head frame 12 when the carriage 11 is at the opposing position 11A is disposed above the carriage 11.

As shown in FIG. 2, the head elevator 17 includes an operating lever 17*a* supported pivotably up and down, an eccentric cam 17*b* that causes the operating lever 17*a* to pivot vertically, a cam drive motor 17*c* that drives the eccentric cam 17*b*, and a coil spring (not shown in the figures) that urges the operating lever 17*a* vertically. The operating lever 17*a* rotates down with rotation of the eccentric cam 17*b*, and pushes the head frame 12 down through the operator 43 disposed to the head frame 12. As a result, the head frame 12 and printhead 7 move down in unison. When the operating lever 17*a* rotates up, the urging force of the four coil springs 48 disposed between the head frame 12 and the carriage frame 13 cause the head frame 12 and the printhead 7 supported thereon to move up.

Figure 7A:
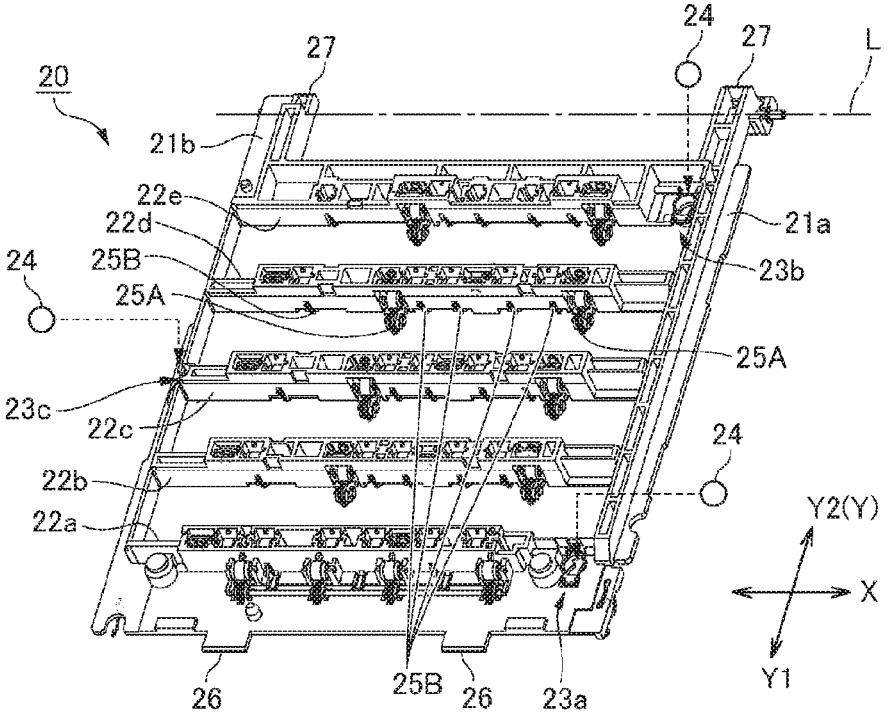
FIGS. 7A and 7B are an oblique view and a bottom view of the platen top unit.
Figure 7B:
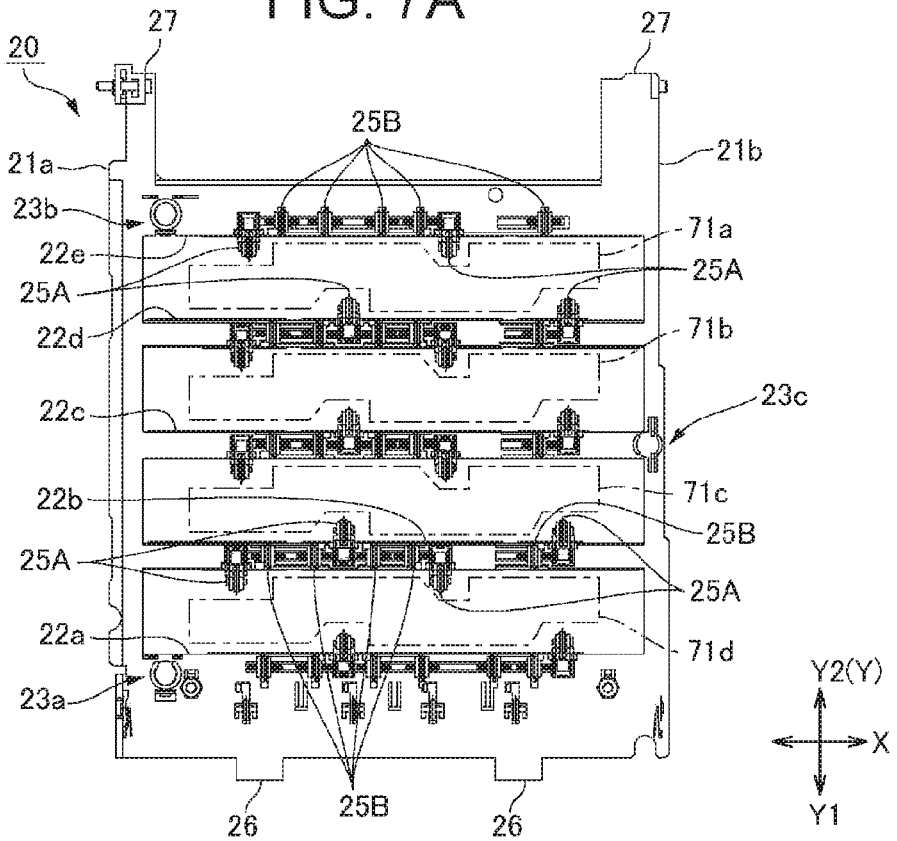

As shown in FIG. 2, the platen top unit 20 is disposed between the platen unit 8 and the printhead 7 and head frame 12. The platen top unit 20 holds the three balls 24 (FIGS. 7A and 7B) between the head frame 12 and the platen unit 8. The head frame 12 is lowered by the head elevator 17 to a position touching these three balls 24 from above. The position of the head frame 12 to the platen unit 8 is determined by the balls 24, and a specific predetermined gap (platen gap) is held between the printhead 7 and platen unit 8. The platen top unit 20 also holds multiple first star wheels 25A and second star wheels 25B (FIGS. 7A and 7B). The recording paper P passing between the platen surface 8*a* and the printhead 7 is set passing below the platen top unit 20. The recording paper P conveyed over the platen surface 8*a* is held down and prevented from lifting away from the platen surface 8*a* by the first star wheels 25A and second star wheels 25B.

Platen Unit

Figure 4:
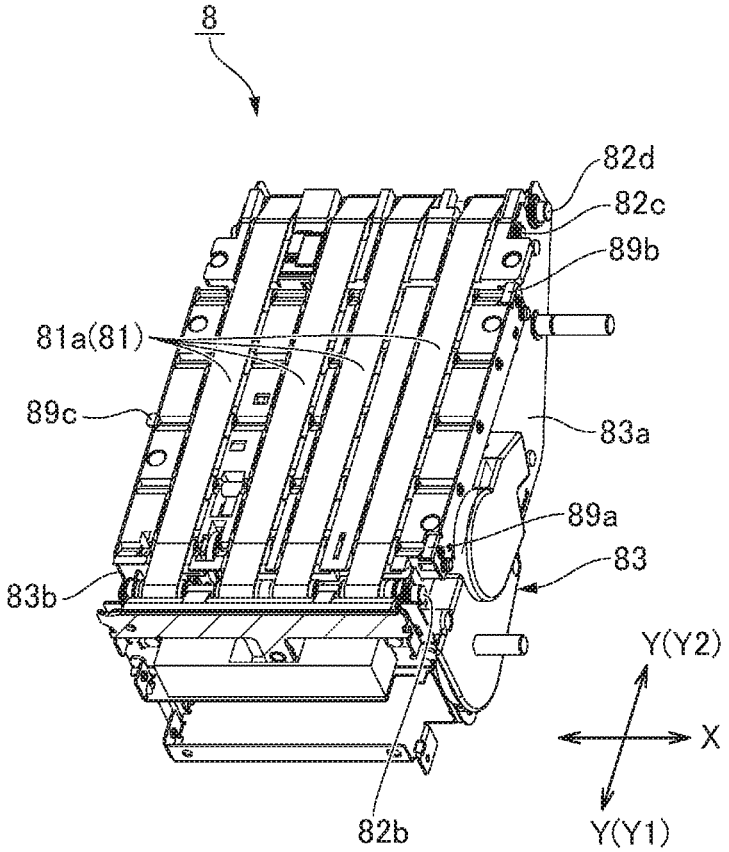
FIG. 4 is an oblique view of the platen unit.

FIG. 4 is an oblique view of the platen unit 8. The platen unit 8 has a main body 83 made of sheet metal, for example. The main body 83 supports a plurality of guide rollers 82*a* to 82*e* (FIG. 5) along the transverse axis X by a pair of side frames 83*a*, 83*b*. The conveyor belt 81 is mounted on the guide rollers 82*a* to 82*e*. A conveyance motor 84 is disposed inside the main body 83, and these comprise the media conveyance mechanism 18 described below.

Platen stops 89*a*, 89*b* are formed at two places at the lengthwise ends of the top of side frame 83*a*. A platen stops 89*c* is formed at one place in the lengthwise center of the top of side frame 83*b*. Platen stops 89*a* to 89*c* are flat horizontal stops bent substantially perpendicularly from the top ends of the side frames 83*a*, 83*b*. The platen stops 89*a*, 89*b*, 89*c* are the parts that each contact one of the three balls 24 held in the platen top unit 20 from above.

Figure 5:
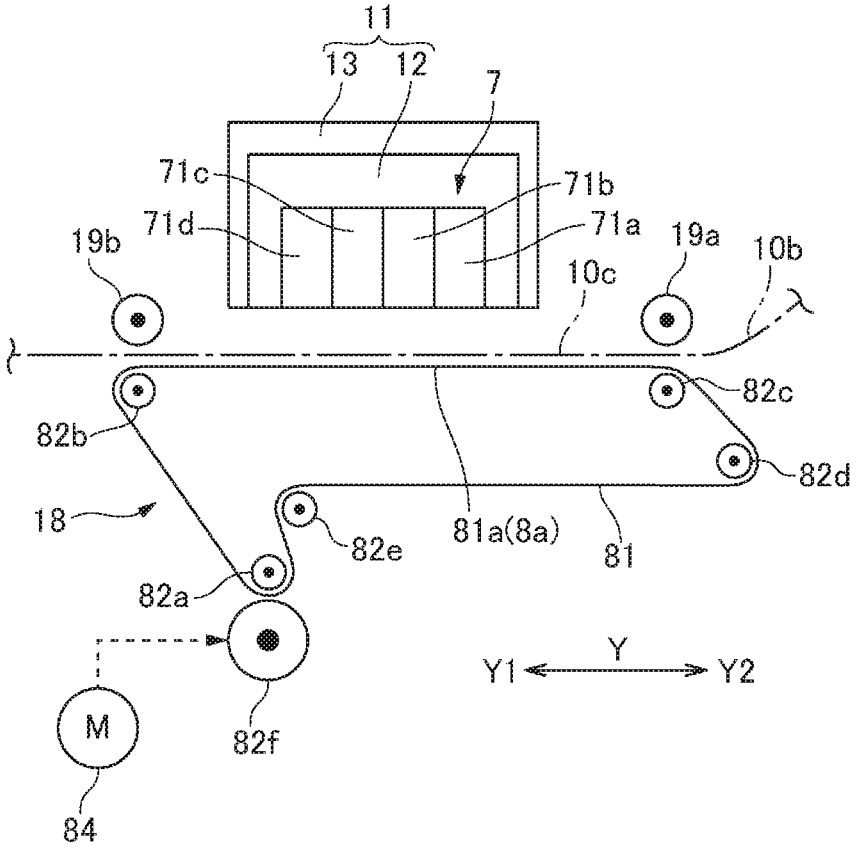
FIG. 5 schematically illustrates the media conveyance mechanism and printhead.

The platen unit 8 includes a conveyor-belt-type media conveyance mechanism 18 in. FIG. 5 schematically illustrates the media conveyance mechanism 18 and the printhead 7. The media conveyance mechanism 18 includes a conveyor belt 81, which is an endless belt located below the third conveyance path section 10*c*; multiple guide rollers 82*a* to 82*e* on which the conveyor belt 81 is mounted; a belt drive roller 82*f* that drives the conveyor belt 81; and a conveyance motor 84 that rotates the belt drive roller 82*f*. The conveyor belt 81 is pushed against the belt drive roller 82*f* by guide roller 82*a*. By rotating the belt drive roller 82*f*, the conveyor belt 81 moves along the path around guide rollers 82*a* to 82*e*.

The portion of the conveyor belt 81 between guide rollers 82*b* and 82*c* is the horizontal belt portion 81*a* extending horizontally over the third conveyance path section 10*c*. Pinch rollers 19*a*, 19*b* are pushed from above the platen unit 8 to the downstream and upstream (that is, the longitudinal axis Y) ends of the horizontal belt portion 81*a* in the conveyance direction. The media conveyance mechanism 18 conveys the recording paper P held between the pinch rollers 19*a*, 19*b* and the horizontal belt portion 81*a*.

As shown in FIG. 2, the recording paper P is pulled from the paper roll 9 loaded in the roll paper compartment 6 to the first conveyance path section 10*a* of the conveyance path 10, wraps around the tension lever 32, and the leader is set passing through the second conveyance path section 10*b* and third conveyance path section 10*c*. Drive power from the media supply motor 31*a* then causes the roll spindle 31 to turn and supply the recording paper P, and executes the conveyance operation of the media conveyance mechanism 18 to index the leading end of the recording paper P to the printing position of the printhead 7. Next, the media conveyance mechanism 18 continues the conveyance operating conveying the recording paper P continuously at a constant speed in the forward direction from the printing position to the paper exit 4A. The printhead 7 is also driven synchronously to the conveyance operation to print on the surface of the recording paper P.

Figure 6:
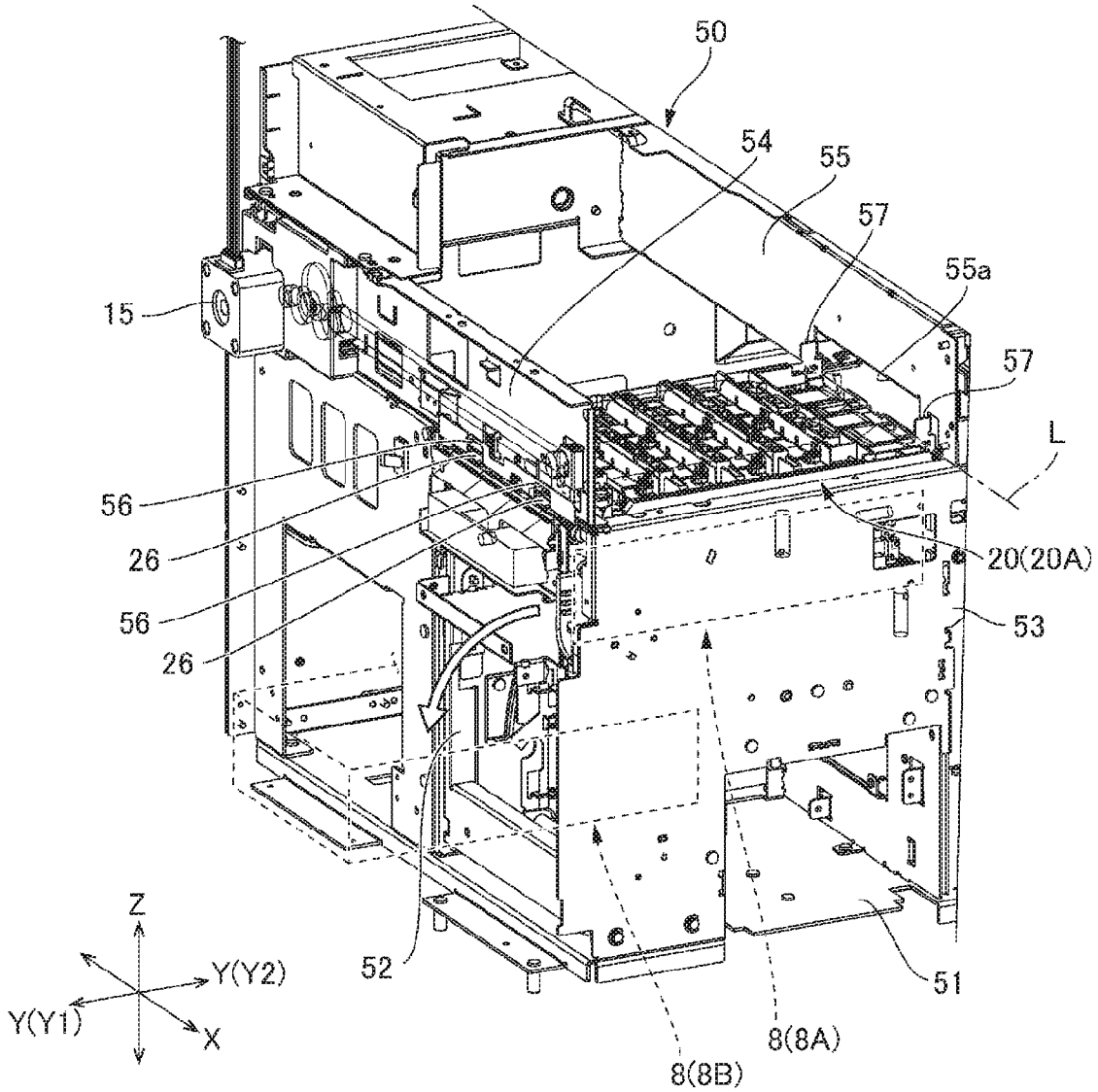
FIG. 6 is an oblique view showing part of the internal mechanism of the printer.

FIG. 6 is an oblique view showing part of the internal configuration of the printer 1. As shown in FIG. 2 and FIG. 6, a sheet metal printer frame 50 is disposed inside the printer cabinet 2, and various components are assembled on the printer frame 50. The printer frame 50 has a base frame 51 located below the platen unit 8, and side frames 52, 53 that rise perpendicularly from the base frame 51 from the sides of the platen unit 8 on the transverse axis X. A front frame 54 and rear frame 55 spanning the transverse axis X above the platen unit 8 are formed at the top ends of the side frames 52, 53. The platen top unit 20 is disposed between the front frame 54 and rear frame 55. The platen unit 8 can move between a head-opposing position 8A below the platen top unit 20, and an open position 8B pulled to the front Y1 below the head-opposing position 8A.

The platen unit 8 is supported by a platen operating mechanism 60 (FIG. 2), and is connected to the access cover 5 that opens and closes the opening 4B formed below the paper exit 4A in the front 2*a* of the printer cabinet 2. When the platen unit 8 is at the head-opposing position 8A, the access cover 5 is upright along the front 2*a* of the printer cabinet 2 (FIG. 1). When the platen unit 8 is pulled to the open position 8B, the access cover 5 pivots at the bottom end thereof and drops forward.

As shown in FIG. 2, the platen operating mechanism 60 has a linkage mechanism 60A that supports the platen unit 8 at a position on the front Y1 side, and a guide mechanism 60B that supports the back Y2 side of the platen unit 8. The linkage mechanism 60A has top support shafts 61, 62 that are parallel to the transverse axis X the front Y1 side of the platen 8, and bottom support shafts 63, 64 that are parallel to the transverse axis X at the bottom of the printer cabinet 2. These four support shafts 61 to 64 are connected by two links 65, 66 that connect matching top and bottom shafts, embodying a parallel linkage mechanism. One set of two links 65, 66 is disposed to each end of the four support shafts 61 to 64.

The guide mechanism 60B includes a pair of curved guide channels 67 (FIG. 2) formed in the pair of side frames 52, 53 (FIG. 6) rising on opposite sides of the platen unit 8 on the transverse axis X, and a guide shaft 68 (FIG. 2) attached to a position on the back Y2 side of the platen unit 8. The left and right ends of the guide shaft 68 are inserted to the pair of curved guide channels 67.

As shown in FIG. 2, when the platen unit 8 is at the head-opposing position 8A, the links 65, 66 of the linkage mechanism 60A are upright on the vertical axis Z. The ends of the guide shaft 68 of the guide mechanism 60B are also positioned at the back Y2 ends of the opposing curved guide channels 67. When the platen unit 8 is pulled to the front Y1 side, the links 65, 66 of the linkage mechanism 60A pivot down at the bottom ends thereof to the front Y1. As a result, the platen unit 8 moves along the curved path of travel to the open position 8B (FIG. 6) while the platen surface 8*a* remains facing the top of the printer. At this time, the guide mechanism 60B follows the movement of the linkage mechanism 60A, the guide shaft 68 travels along the curved guide channels 67, and the back end part of the platen unit 8 moves along the curved path of travel.

When the platen unit 8 moves to the open position 8B, a large gap is formed between the platen unit 8 and the platen top unit 20, and the third conveyance path section 10*c* of the conveyance path 10 opens greatly to the front Y1 side. As a result, the user can insert his hand and remove paper jams between the printhead 7 and the platen top unit 20 and platen unit 8.

Platen Top Unit Support Mechanism

As shown in FIG. 2 and FIG. 6, the platen top unit 20 is a thin unit disposed above the platen unit 8, and is separated from the platen unit 8. The platen top unit 20 is supported movably on the vertical axis Z by the front frame 54 and rear frame 55 at the longitudinal axis Y ends of the platen top unit 20. The platen top unit 20 can move to a first position 20A (FIG. 2, FIG. 8B) where it contacts the platen unit 8 from above, and a second position 20B (FIG. 8C) separated from the platen unit 8 more than at the first position 20A.

FIG. 7A is an oblique view from diagonally above the top of the platen top unit 20, and FIG. 7B is a bottom view thereof from the platen unit 8 side. The platen top unit 20 includes a pair of longitudinal frame members 21*a*, 21*b* extended parallel to the longitudinal axis Y, and five transverse frame members 22*a*-22*e* extending parallel to the transverse axis X. The ends of the transverse frame members 22*a*-22*e* are connected to the longitudinal frame members 21*a*, 21*b*. Ball receivers 23*a*, 23*b* are disposed to the longitudinal frame member 21*a* at two locations, on one side and the other side, on the longitudinal axis Y. Another ball receiver 23*c* is disposed to the longitudinal frame member 21*b* near the center on the longitudinal axis Y. The three balls 24 that function as spacers to hold a constant platen gap are supported movably in the ball receivers 23*a* to 23*c*. The ball receiver 23*a* is a construction having a wire support member that supports a ball 24 movably inside a through-hole in the longitudinal frame member 21*a*, and the other ball receivers 23*b* and 23*c* are identically constructed.

The platen top unit 20 includes multiple first star wheels 25A attached to the transverse frame members 22*a*-22*e*, and multiple second star wheels 25B attached to the transverse frame members 22*a*-22*e*. Each of the first and second star wheels 25A, 25B has protrusions formed at a constant angular pitch around the outside. The first and second star wheels 25A, 25B are supported rollably by the transverse frame members 22*a*-22*e*, and the outside surfaces are below the transverse frame members 22*a*-22*e* on the vertical axis Z. The first and second star wheels 25A, 25B are also supported movably on the vertical axis Z, and are urged down by an urging member not shown. As a result, if recording paper P is set with the platen unit 8 set to the head-opposing position 8A, and the platen top unit 20 is positioned to the first position 20A (FIG. 2, FIG. 8B) touching the platen unit 8, the first and second star wheels 25A, 25B flexibly contact the recording paper P on the platen surface 8*a*.

Two tabs 26 that protrude to the front Y1 from the transverse frame member 22*a* are formed on the front Y1 end of the platen top unit 20. Two arms 27 that protrude to the back Y2 side from the opposite side of the transverse frame member 22*e* on the transverse axis X are also formed on the back Y2 end of the platen top unit 20.

As shown in FIG. 6, the platen top unit 20 is disposed above the platen unit 8 and between the front frame 54 and rear frame 55. The rear frame 55 located on the back Y2 side of the platen top unit 20 has a notch 55*a* that is long on the transverse axis X, and two connectors 57 are formed protruding to the front Y1 from the transverse axis X ends of the notch 55*a*. The arms 27 formed on the back end of the platen top unit 20 are connected to the connectors 57 pivotably on an axis of rotation L extending on the transverse axis X.

The front frame 54 located on the front Y1 side of the platen top unit 20 has two openings 56 formed opposite the tabs 26. The openings 56 are disposed so that the tabs 26 can move on the vertical axis Z. The front part of the platen top unit 20 is therefore supported movably on the vertical axis Z.

Figure 8A:
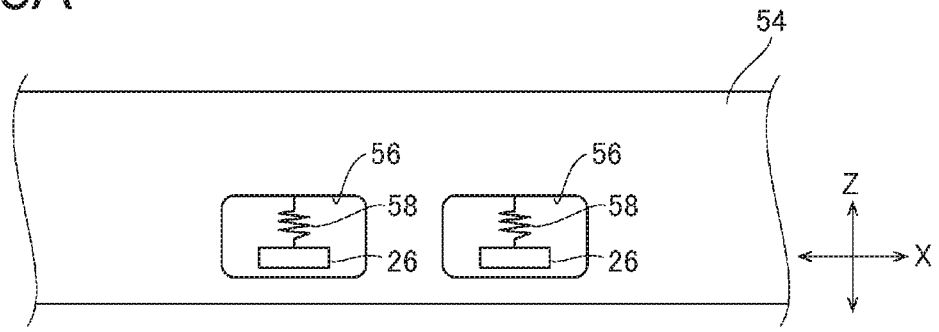
FIGS. 8A to 8C schematically illustrate the support structure of the platen top unit.
Figure 8B:
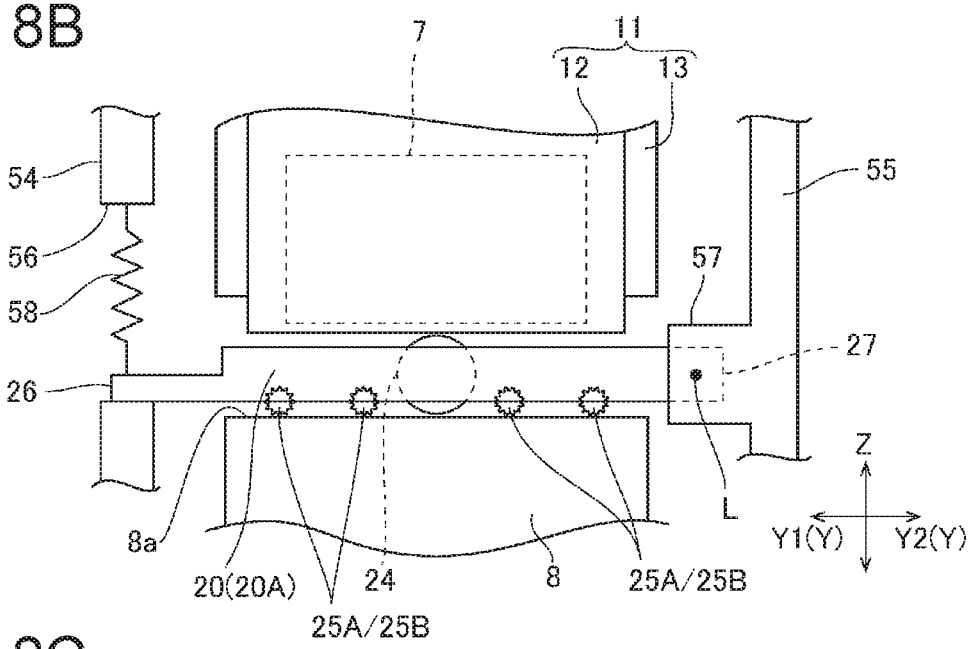
Figure 8C:
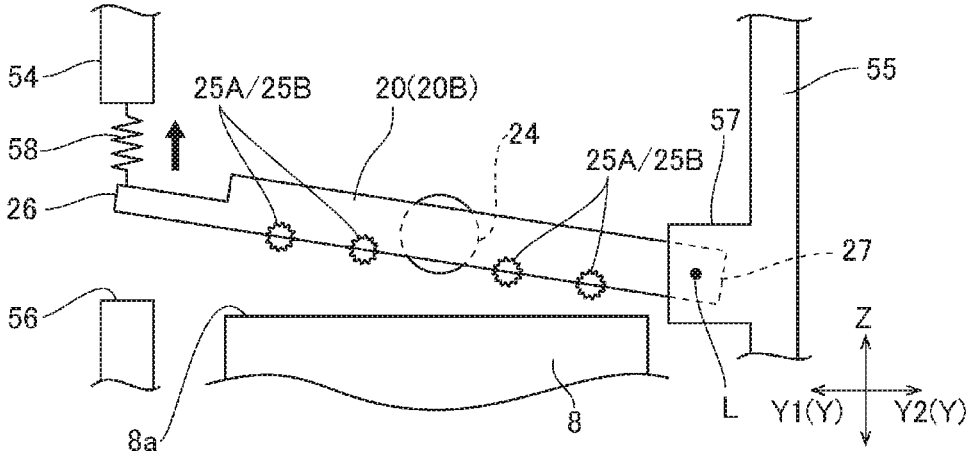

FIGS. 8A to 8C schematically describe a support structure of the platen top unit 20, FIG. 8A being a view from the front Y1, and (b) and (c) being side views from one side on the transverse axis X. As shown in FIG. 8A, tension springs 58 that urge the tabs 26 up are attached between the top edge of the opening 56 and the tabs 26. The platen top unit 20 is urged by the urging force of the tension springs 58 to pivot up on the back end thereof connected to the connectors 57 of the rear frame 55.

The first position 20A shown in FIG. 8B is the bottom end of the range of platen top unit 20 movement. The platen top unit 20 holds the three positioning balls 24 as described above, and is set to the first position 20A by the head-side stops 44*a*, 44*b*, 44*c* of the head frame 12 that holds the printhead 7 contacting the balls 24 from above, and the platen stops 89*a*, 89*b*, 89*c* of the platen unit 8 contacting the balls 24 from below. In the first position 20A, the tabs 26 are near the bottom end of the openings 56, and the platen top unit 20 is substantially parallel to the platen surface 8*a*.

The second position 20B shown in FIG. 8C is a position at the top end of the range of platen top unit 20 movement where the urging force of the tension spring 58 and the weight of the platen top unit 20 are balanced. When an escape space is formed above the platen top unit 20 by the carriage 11 moving to the standby position 11B (FIG. 1), for example, the platen top unit 20 is lifted up at the tabs 26 by the urging force of the tension spring 58, and the platen top unit 20 swings up pivoting on the axis of rotation L passing through the back end connected to the connectors 57 of the rear frame 55. As a result, the tabs 26 are positioned at an upward angle when at the second position 20B.

Operation of the Platen Top Unit

Figure 9A:
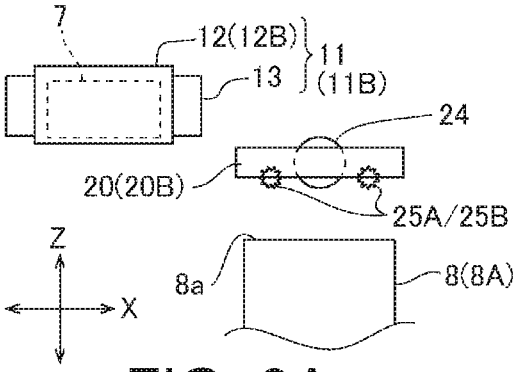
FIGS. 9A to 9E describe operating the platen top unit.
Figure 9B:
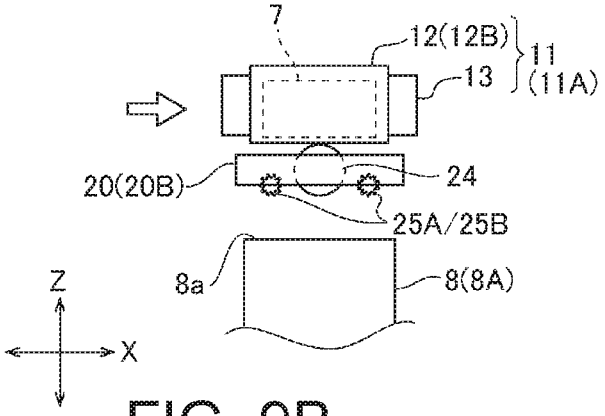
Figure 9C:
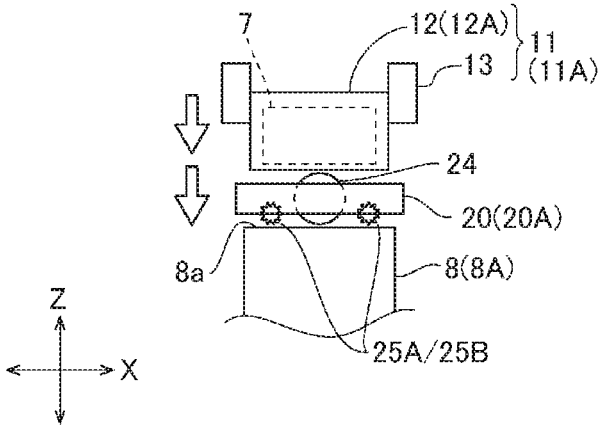
Figure 9D:
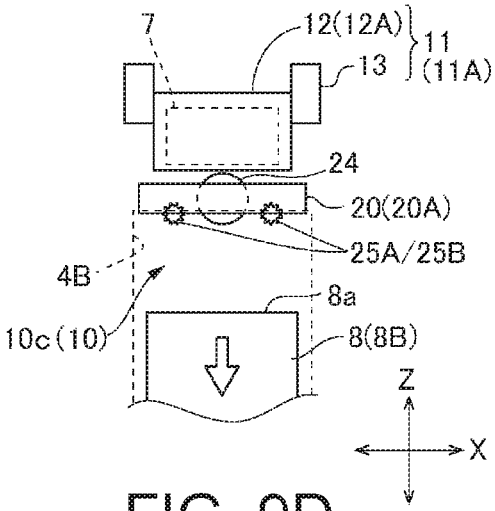
Figure 9E:
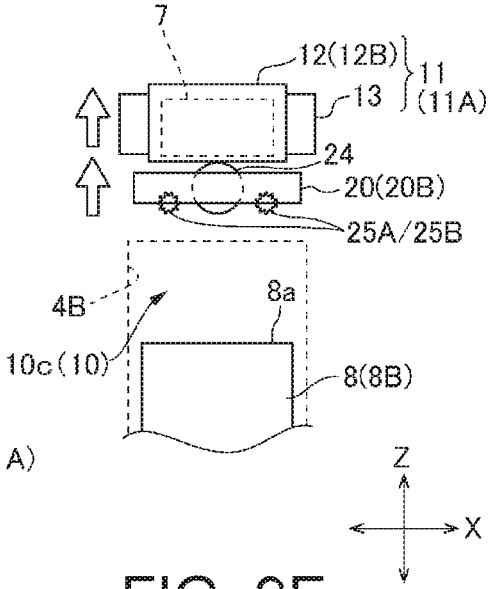

FIGS. 9A to 9E describe operations of platen top unit 20, and shows the platen top unit 20 from the Y1 side. FIGS. 9A to 9C describe the operation whereby the carriage 11 moves from the standby position 11B to the opposing position 11A, and creates a specific platen gap between the printhead 7 and platen unit 8. FIGS. 9D and 9E describe the operation of pulling the platen unit 8 to the front of the device and opening the third conveyance path section 10*c* of the conveyance path 10.

As described above, the carriage 11 carrying the printhead 7 can be moved by the carriage moving mechanism 15 along the carriage guide rails 14, and move between the opposing position 11A (FIG. 1, FIG. 9B, and FIG. 9C) opposite the platen unit 8, and the standby position 11B (FIG. 1, FIG. 9A) retracted from the platen unit 8. In addition, when the carriage 11 is at the opposing position 11A, the part of the head frame 12 holding the printhead 7 can be moved on the vertical axis Z relative to the carriage frame 13 by means of the head elevator 17. The head frame 12 moves between the platen gap holding position 12A (FIG. 9C) pushing the balls 24 of the platen top unit 20 against the platen unit 8, and a raised position 12B (FIGS. 9A and 9B) not touching the balls 24.

To avoid interference between the carriage 11 and the printhead 7 and platen top unit 20, the operation of moving the carriage 11 between the opposing position 11A and standby position 11B is executed when the head frame 12 holding the printhead 7 is moved to the raised position 12B as shown in FIGS. 9A and 9B. When not depressed by the head frame 12, the platen top unit 20 pivots up and moves to the second position 20B. The raised position 12B is set to a position where there is no interference between the platen top unit 20 moved to the second position 20B and the head frame 12.

As shown in FIG. 9C, to print on the recording paper P with the printhead 7, the head elevator 17 is driven to lower the head frame 12 and the printhead 7 to the carriage frame 13. As a result, the balls 24 held by the platen top unit 20 function as spacers between the head frame 12 and platen unit 8, the head frame 12 is positioned to the platen gap holding position 12A, and a specific gap (platen gap) is held between the nozzle face of the printhead 7 and the platen surface 8*a*. Furthermore, because the platen top unit 20 is set to the first position 20A in contact with the platen unit 8, the first and second star wheels 25A, 25B flexibly contact the recording paper P set on the platen surface 8*a*.

To restore the printer 1 to printing condition when a printer 1 error such as a paper jam occurs, for example, the user opens the access cover 5 and pulls the platen unit 8 from the head-opposing position 8A through the opening 4B in the front 2*a* to the open position 8B. At this time, as shown in FIG. 9D, the platen unit 8 descends, a large gap to the platen top unit 20 opens, and the third conveyance path section 10*c* of the conveyance path 10 opens wide. As a result, recording paper P stuck in the third conveyance path section 10*c* can be removed from the opening 4B in the front 2*a*.

Because the platen top unit 20 is at the first position 20A when the head frame 12 is at the platen gap holding position 12A, the first and second star wheels 25A, 25B will be exposed from the opening 4B in the front 2*a* (FIG. 9D) if the platen unit 8 is moved to the open position 8B without moving the head frame 12. The control unit of the printer 1 therefore controls the head elevator 17 to move the head frame 12 to the raised position 12B (FIG. 9E) if movement of the platen unit 8 to the open position 8B is detected. Because this moves the platen top unit 20 to the second position 20B, the first and second star wheels 25A, 25B move up away from the opening 4B in the front 2*a*, and are not exposed from the opening 4B.

In addition to driving the head elevator 17 to raise the head frame 12 based on the operation of opening the platen unit 8, moving the platen top unit 20 to the second position 20B when the platen unit 8 opens may alternatively be controlled by driving the head elevator 17 based on detection of a paper jam to move the platen top unit 20 to the second position 20B before opening the platen unit 8.

As described above, the platen top unit 20 that supports the first and second star wheels 25A, 25B in the printer 1 according to this embodiment is separate from the openable platen unit 8, and is supported movably vertically. Therefore, when the platen unit 8 is moved to the open position 8B to open the third conveyance path section 10*c* of the conveyance path 10 when a paper jam occurs, for example, the platen top unit 20 can be raised by controlling the head elevator 17. Therefore, the first and second star wheels 25A, 25B supported by the platen top unit 20 can be retracted from the position where they may be easily be touched by the user. The chance of damaging the first and second star wheels 25A, 25B and a drop in ease of maintenance can therefore be avoided. Furthermore, because a member for covering the first and second star wheels 25A, 25B and a mechanism for moving such a member, are not needed, damage to the first and second star wheels 25A, 25B and a drop in ease of use can be avoided by a simple configuration.

The platen top unit 20 is supported by the front frame 54 and rear frame 55 movably on the vertical axis Z. More specifically, the platen top unit 20 is supported with the tabs 26 of the platen top unit 20 urged up inside the openings 56 in the front frame 54, and the rear end of the platen top unit 20 is supported pivotably up and down by the connectors 57 of the rear frame 55. The platen top unit 20 is therefore supported movably vertically by a simple configuration.

Furthermore, because the platen top unit 20 is retracted in the direction above and away from the platen surface 8*a* (vertically relative to the platen surface 8*a*), the space from which the printhead 7 and head frame 12 are retracted can be used as the retraction space for the platen top unit 20. Space can therefore be used efficiently to make the printer 1 smaller.

Furthermore, the head elevator 17 in this embodiment can be used to move the platen top unit 20 by means of the head frame 12, and the urging force of the tension springs 58 can be used to raise the platen top unit 20. A separate drive source is therefore not needed to move the platen top unit 20. The configuration of parts can therefore be simplified.

Other Embodiments

The rear end of the platen top unit 20 is pivotably attached to the rear frame 55, but the support structure at the back end of the platen top unit 20 may be configured identically to the front end. For example, the arms 27 at the back end of the platen top unit 20 may be disposed inside openings formed in the rear frame 55, and the platen top unit 20 urged up by springs, for example. In this event, the platen top unit 20 can move vertically while held horizontally.

This embodiment applies the invention to an inkjet line printer, but the invention is not so limited and may be applied to a serial printer.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a printhead;

a platen including a platen surface which is configured for supporting sheet media, configured to move between a head-opposing position where the platen surface is opposite the printhead and an open position, a gap between the platen surface and the printhead when the platen is at the open position is larger than the gap when the platen is at the head-opposing position;

a star wheel support member supporting a star wheel configured for suppressing the media, disposed vertically between the printhead and the platen at the head-opposing position;

a support frame configured to support the star wheel support member movably between a first position and a second position; and a spring disposed between the support frame and the star wheel support member, that urges the star wheel support member to the second position; wherein the star wheel is in contact with the sheet media on the platen surface when the star wheel support member is at the first position, and is separated from the sheet media on the platen surface when the star wheel support member is at the second position;

the support frame includes a first frame disposed on one side of the platen unit, the first frame has a first opening extending in the direction of movement of the star wheel support member between the first position and the second position;

the star wheel support member includes a first protrusion disposed in the first opening, the first protrusion is formed on one end of the star wheel support member; and the spring includes a first spring attached to the first protrusion that urges the star wheel support member from the first position toward the second position.

2. The printer described in claim 1, wherein:

the support frame includes a second frame disposed on the other side of the platen unit, and the second frame has a second opening extending in the direction of movement of the star wheel support member;

the star wheel support member includes a second protrusion disposed in the second opening, the second protrusion is formed on the other end of the star wheel support member; and the spring includes a second spring attached to the second protrusion that the urges the star wheel support member from the first position toward the second position.

3. The printer described in claim 1, wherein:

the support frame has a second frame disposed on the other side of the platen unit; and the second frame pivotably supports the other end of the star wheel support member.

4. The printer described in claim 1, wherein:

the direction of movement of the star wheel support member is perpendicular to the platen surface.

5. The printer described in claim 4, further comprising:

a support frame that supports the star wheel support member movably between the first position and the second position; wherein the urging member disposed between the support frame and the star wheel support member.

6. The printer described in claim 5, wherein:

the support frame includes a first frame on which a first opening extending in the direction of movement of the star wheel support member is formed;

the star wheel support member includes a first protrusion configured to move in the first opening; and a first urging member as the urging member is attached to the first protrusion.

7. The printer described in claim 6, wherein:

the first frame is on one side of the star wheel support member;

the support frame includes a second frame on which a second opening extending in the direction of movement of the star wheel support member is formed, the second frame is on the other side of the star wheel support member;

the star wheel support member includes a second protrusion configured to move in the second opening; and a second urging member as the urging member is attached to the second protrusion.

8. The printer described in claim 6, wherein:

the first frame is on one side of the star wheel support member;

the first protrusion is on one end of the star wheel support member;

the support frame includes a second frame on the other side of the star wheel support member; and the second frame pivotably supports the other end of the star wheel support member.

9. A printer comprising:

a platen including a platen surface;

a printhead configured to move between a first head position and a second head position, a gap between the platen surface and the printhead at the second head position is larger than the gap between the platen surface and the printhead at the first head position;

a star wheel support member supporting a star wheel, configured to move between a first position and a second position, a gap between the star wheel and the platen surface when the star wheel support member is at the second position is larger than the gap when the star wheel support member is at the first position, wherein the star wheel support member is pressed against the platen surface by the printhead moving from the second head position toward the first head position.

10. The printer described in claim 9, wherein:

the printhead at the first head position prints a sheet media on the platen surface; and the star wheel support member moves from the first position toward the second position when the printhead moves from the first head position toward the second head position.

11. The printer described in claim 10, further comprising:

an urging member configured to urge the star wheel support member toward the second position.

12. The printer described in claim 10, wherein:

the printhead moves from the first head position toward the second head position, when a paper jam is detected.

13. The printer described in claim 10, wherein:

the platen moves between a first platen position and a second platen position, a gap between the printhead at the first head position and the platen surface of the platen at the second platen position is larger than the gap between the printhead at the first head position and the platen surface of the platen at the first position.

14. The printer described in claim 13, wherein:

while the platen moving from the first position toward the second position, the print head moves to the second head position.

* * * * *